US010415782B2

(12) United States Patent
Kliebisch et al.

(10) Patent No.: US 10,415,782 B2
(45) Date of Patent: Sep. 17, 2019

(54) LIGHTING DEVICE FOR VEHICLES

(71) Applicant: Hella KGaA Hueck & Co., Lippstadt (DE)

(72) Inventors: Dirk Kliebisch, Paderborn (DE); Jaroslaw Schimon, Bielefeld (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 130 days.

(21) Appl. No.: 15/315,485

(22) PCT Filed: Jun. 26, 2015

(86) PCT No.: PCT/EP2015/064576
§ 371 (c)(1),
(2) Date: Dec. 1, 2016

(87) PCT Pub. No.: WO2016/001098
PCT Pub. Date: Jan. 7, 2016

(65) Prior Publication Data

US 2017/0167682 A1 Jun. 15, 2017

(30) Foreign Application Priority Data

Jun. 30, 2014 (DE) ..... 10 2014 109115

(51) Int. Cl.
*F21S 41/19* (2018.01)
*F21S 41/143* (2018.01)
(Continued)

(52) U.S. Cl.
CPC ..... *F21S 41/19* (2018.01); *F21S 41/143* (2018.01); *F21S 41/255* (2018.01); *F21S 41/26* (2018.01);
(Continued)

(58) Field of Classification Search
CPC ..... F21S 48/1225; F21S 41/26; F21S 41/663; F21S 41/143; F21S 41/255; F21S 41/19;
(Continued)

(56) References Cited

U.S. PATENT DOCUMENTS 7,988,345 B2 * 8/2011 Rosenhahn ..... F21V 5/08 362/538
2010/0002460 A1 1/2010 Rosenhahn et al.
(Continued)

FOREIGN PATENT DOCUMENTS

CN 102966896 A 3/2013
DE 102010017275 A1 4/2011
(Continued)

*Primary Examiner* — Anh T Mai
*Assistant Examiner* — Jessica M Apenteng
(74) *Attorney, Agent, or Firm* — Husch Blackwell LLP

(57) ABSTRACT

A lighting device for vehicles with a multitude of light modules, each comprising a light source arranged on a substrate and a lens arranged at a distance to the light source for the creation of a given light distribution. A fixed side light module and a fixed main light module are provided as a light module. The side light module has an asymmetric lens, so that a light beam radiated by the side light module creates a side light distribution extending a main light distribution created by the main light module in the lateral direction.

8 Claims, 3 Drawing Sheets

(51) Int. Cl.

| | |
|---|---|
| ***F21S 41/20*** | (2018.01) |
| ***F21S 41/255*** | (2018.01) |
| ***F21S 41/26*** | (2018.01) |
| ***F21S 41/663*** | (2018.01) |
| *F21Y 115/10* | (2016.01) |
| *F21S 45/47* | (2018.01) |

(52) U.S. Cl.
CPC ..... *F21S 41/285* (2018.01); *F21S 41/663* (2018.01); *F21S 45/47* (2018.01); *F21Y 2115/10* (2016.08)

(58) Field of Classification Search
CPC ..... F21S 41/285; F21S 45/47; F21S 48/1747; F21S 48/328; F21S 48/1104; F21S 48/1154; F21Y 2115/10
USPC ..... 362/520
See application file for complete search history.

(56) References Cited

U.S. PATENT DOCUMENTS

| | | | | |
|---|---|---|---|---|
| 2012/0038272 | A1* | 2/2012 | De Castro | F21S 41/143 315/35 |
| 2013/0010485 | A1* | 1/2013 | Sikkens | B60Q 1/122 362/465 |
| 2013/0169154 | A1* | 7/2013 | Kay | B60Q 1/12 315/81 |
| 2014/0313762 | A1* | 10/2014 | Owada | B60Q 1/0088 362/538 |

FOREIGN PATENT DOCUMENTS

| | | | |
|---|---|---|---|
| DE | 102012211613 | A1 | 1/2014 |
| WO | 2009020000 | A1 | 2/2009 |

* cited by examiner

LIGHTING DEVICE FOR VEHICLES

CROSS REFERENCE

This application claims priority to PCT Patent Application No. PCT/EP2015/064576, filed 26 Jun. 2015, which itself claims priority to German Application No. 10 2014 109115.9, filed 30 Jun. 2014, the entirety of both of which are hereby incorporated by reference.

FIELD OF THE INVENTION

The invention relates to a lighting device for vehicles having a multitude of light modules, each comprising a light source arranged on a substrate and a lens arranged at a distance to the light source, for the creation of a given light distribution.

BACKGROUND OF THE INVENTION

A lighting device for vehicles is known from WO 2009/020000 A1, which has a light module working according to the projection principle. A light source embodied as an LED light source is arranged on a substrate being fastened to a heatsink. In the area of the light source, a cut-off line screen is provided for the generation of a cut-off line. A lens arranged at a distance forms the light source for the generation of the light distribution. To this end, the light source respectively the cut-off line screen is arranged in the area of a focal point of the lens. Also a plurality of such light modules may be arranged in a housing of the lighting device, as is known from U.S. Pat. No. 8,506,137 B2. The embodiment of one of the light modules in a movable manner is known which ensures the optimal illumination of the road space during cornering by illuminating an extended lateral area. This has the disadvantage, that an actuator must be assigned to the light module to be moved, which takes up additional space. In particular, the lighting device has a relatively large installation depth due to this.

SUMMARY OF THE INVENTION

It is, therefore, the task of the present invention to develop further a lighting device for vehicles with a multitude of light modules working according to the projection principle in a manner, that a light distribution extended in the lateral direction is ensured with little effort, wherein particularly the required space is to be kept at a minimum.

To solve this task, the invention in connection with the preample of claim 1 is characterized in that a fixed side light module and a fixed main light module are provided as a light module, wherein the side light module has an asymmetric lens, so that a light beam radiated by the side light module creates a side light distribution extending the main light distribution created by the main light module in the lateral direction.

The particular advantage of the invention is that by providing a fixed side light module, a main light distribution created by at least one further main light module can be extended in the lateral direction, so that a total light distribution enlargened in the horizontal direction can be created. The creation of a side light distribution by the side light module is achieved by an asymmetric lens, which is embodied in a fixed manner. In comparison with the main light module, no additional component parts are required. The extending side light distribution is achieved by the design of the lens, so that the lighting device has, overall, a relatively flat layout. In addition, the contour of a bezel encircling the light modules can be adhered to.

According to a preferred embodiment of the invention, the asymmetric lens has a cut edge whose distance to a central axis of the asymmetric lens is smaller than a distance of an opposite outer edge to the same. By means of the cut edge, a limitation of the side light distribution on a free lateral end of the same is achieved.

According to a further development of the invention, the side light module as well as the main light module are positioned so that a vertical cut-off line of the side light distribution and a vertical cut-off line of the main light distribution run on a common plane. Advantageously, a defined connection of the side light distribution to an end of the main light distribution is achieved. In the switched-off condition of the side light module, the total light distribution ends at this vertical cut-off line of the main light distribution.

According to a further development of the invention, the side light module can be switched on and off depending on a steering direction of the vehicle, so that it can be used as a bend lighting function of the lighting device.

According to a further development of the invention, the side light module and the main light module each have a lens holder being fastened on a heat sink carrying the substrates of the respective light sources or on a carrier frame carrying the respective light sources. Advantageously, the light modules have an identical design and may have identical dimensions, so that a uniform appearance is provided particularly in the switched-off state.

According to a further development of the invention, the lens of the main light module is embodied plano-convex and the lens of the side light module is embodied partly plano-convex, the lens of the side light module having a cut-off lateral area. Due to the similar dimensioning of the lenses, these have a similar appearance in the switched-off state of the lighting device.

According to a further development of the invention, the arrangement of the side light module and the main light module is offset in parallel, so that the light modules always have the same alignment in the housing.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
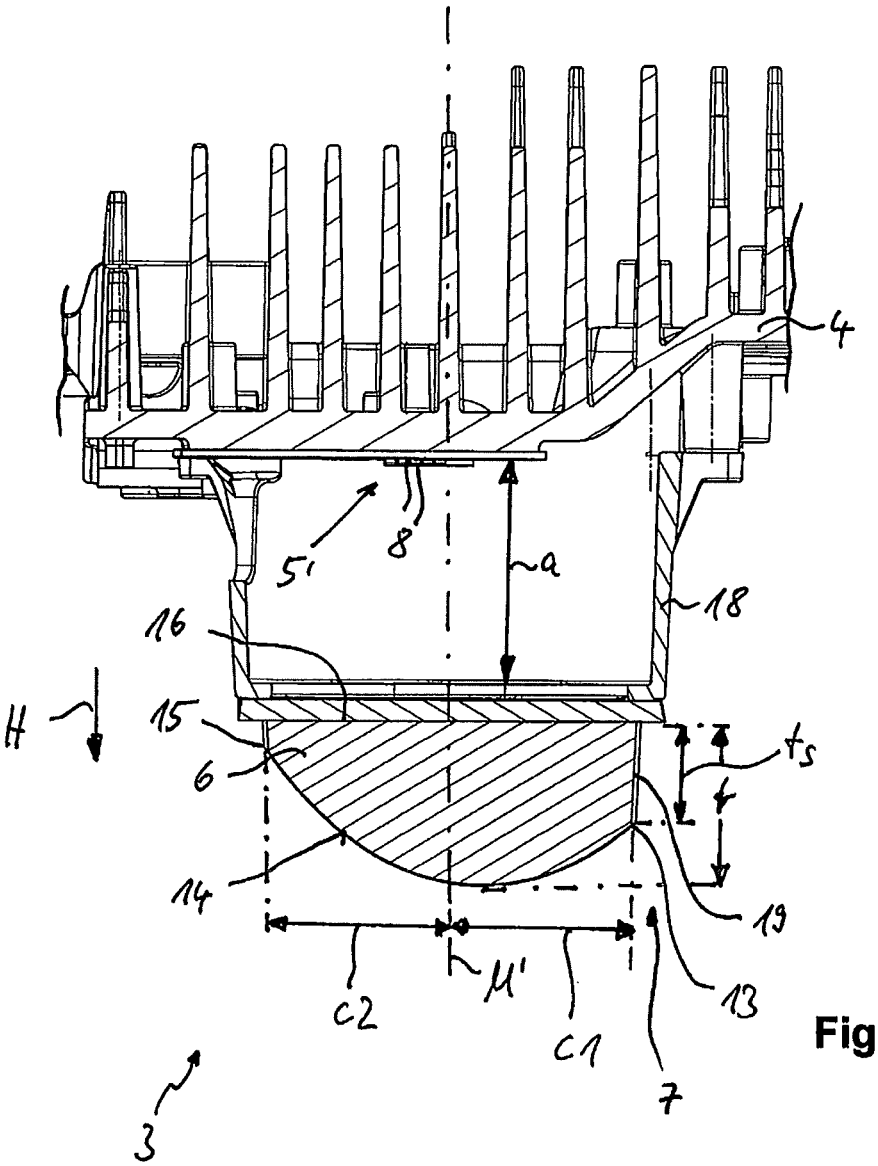
FIG. 1 is a horizontal section through a side light module of a lighting device.
Figure 2:
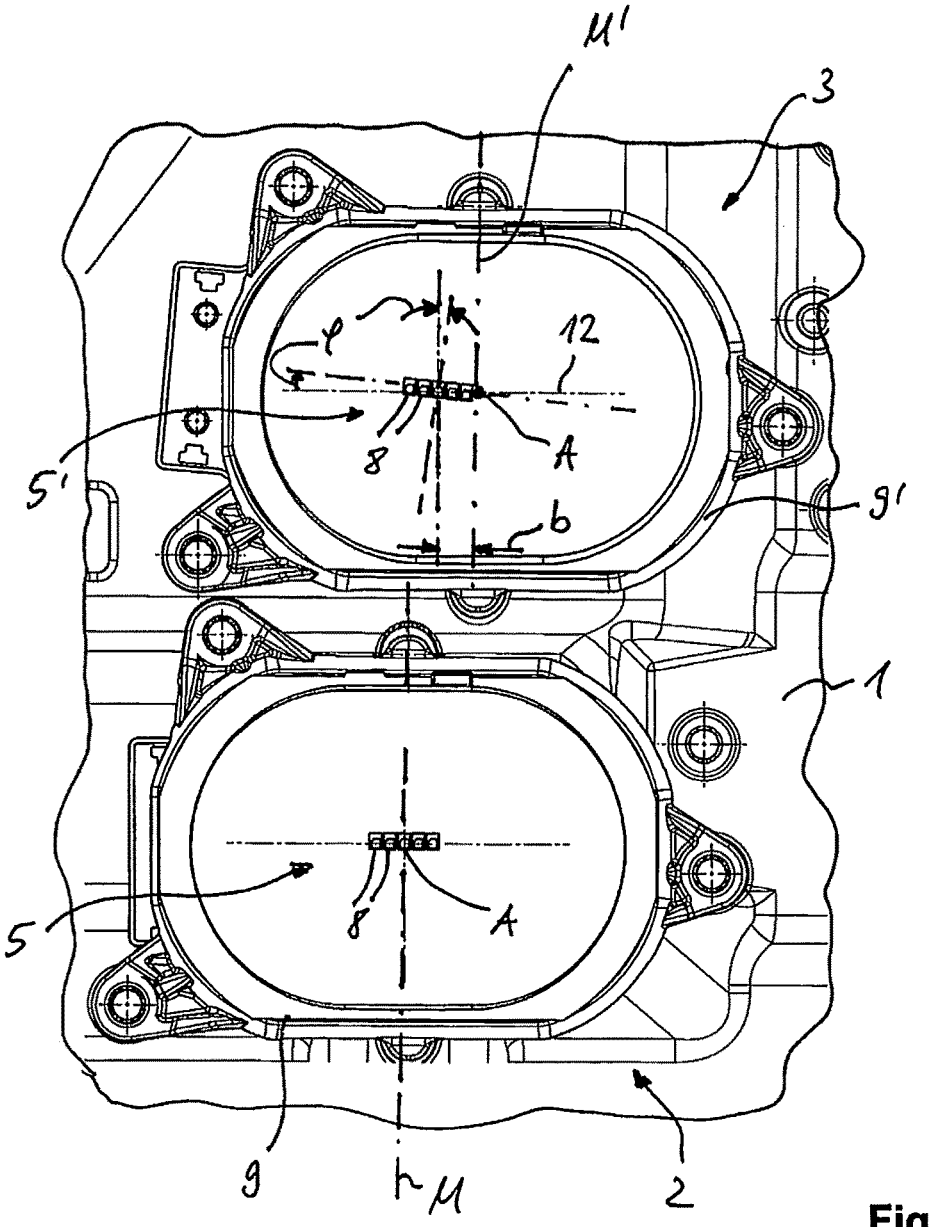
FIG. 2 is a front view of a part of the lighting device with the side light module and with a main light module.
Figure 3:
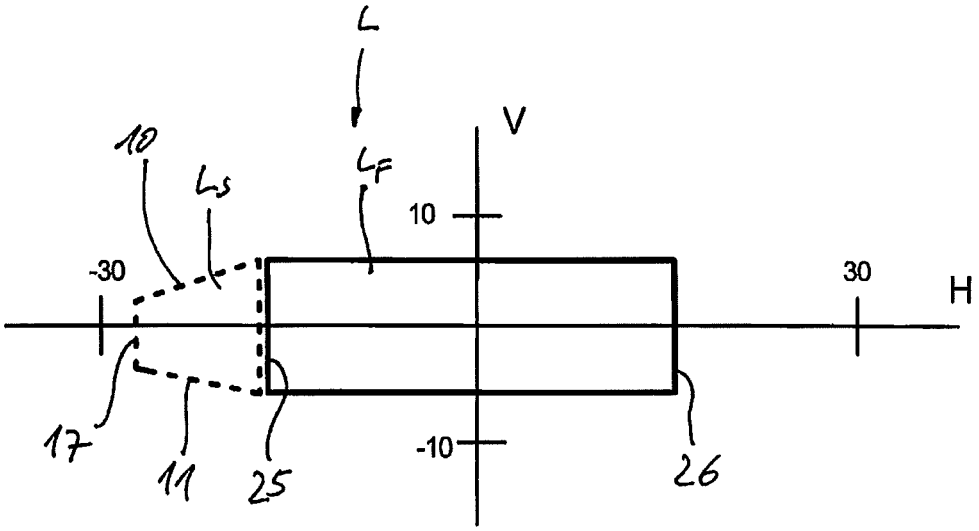
FIG. 3 is a schematic representation of a light distribution of a left-hand headlamp of the lighting device.

A lighting device according to the invention is preferably used for headlamps of vehicles. A left-hand headlamp with regard to a longitudinal vehicle axis in the driving direction, as well as a right-hand headlamp have one housing 1 each, in which a multitude of main light modules 2 and a side light module 3 are arranged. The FIGS. 1 to 3 show a part of the left-hand headlamp comprising three identical main light modules for the creation of a high beam distribution $L_F$ serving as a main light distribution, and a single side light module 3 for the creation of a side light distribution $L_S$ . As can be seen in FIG. 3, the side light distribution $L_S$ abuts, in the driving direction, on a left-hand edge 25 (left-hand vertical cut-off line) of the left-hand side of the high beam light distribution $L_F$. The side light distribution $L_S$ therefore extends the high beam light distribution $L_F$ by a lateral connection area on a left-hand side of the same.

The right-hand headlamp, which is not represented, has a housing in which three identical main light modules 2 and a single side light module are arranged. The main light modules 2 serves the creation of the high beam distribution $L_F$ .The side light module serves the creation of a side light distribution which abuts in the horizontal direction on a right-hand edge 26 resp. right-hand cut-off line of the high beam light distribution $L_F$. The side light distribution $L_S$ therefore extends the high beam light distribution $L_F$ by a lateral connection area on a left-hand side of the same.

The light modules (main light module 2, side light module 3) of the lighting device have a similar design. Each has a heatsink 4 serving as a carrier for a substrate on which a light source 5, 5' is positioned. Furthermore, the light modules 2, 3 each have a lens holder and a lens which is arranged at a distance a in the main radiation direction H.

The side light module 3 differs from the main light module 2 essentially in that the lens of the side light module is embodied as an asymmetric lens 6 having a cut off lateral area 7 on a side facing toward the lateral connection area of the main light distribution $L_F$ to be illuminated. The asymmetric lens 6 of the side light module 3 represented in FIG. 1 is embodied cut-off on the left-hand side in the driving direction, so that the side light distribution $L_S$ abuts on a left-hand side of the high-beam light distribution $L_F$, see FIG. 3. In the right-hand headlamp, the asymmetric lens 6 is arranged mirror-imaged relative to a vertical center plane M' of the same, so that the cut-off lateral area 7 is arranged on a right side of the lens 6 in the driving direction. By this means, the side light distribution $L_S$ is arranged abutting on the right-hand edge 26 of the high beam light distribution $L_F$.

As can be seen in FIG. 2, the light source 5, 5' of the main light module 2 and of the side light module 3 each consist of five light sources 8 arranged in a straight row, which are preferably embodied as LED-light sources. The side light module 3 has a light source 5' being arranged offset by a distance b in the horizontal direction relative to an optical axis A resp. to the vertical center plane M'. The light source 5' is therefore arranged eccentric relative to the asymmetric lens 6, respectively to an oval-shaped bezel 9' encircling the asymmetric lens 6.

The light source 5 of the main light module 2 is arranged centrically relative to a central axis M of the lens arranged in front of it, respectively to a bezel 9 encircling this lens. As the light source 5, like the light source 5', consists of 5 LED light sources 8, the central LED light source 8 cuts the vertical central axis M, respectively the optical axis A of the same.

A horizontal offset of the side light distribution $L_S$ relative to the high beam light distribution $L_F$ is realized by the horizontal relative offset of the light source 5 of the main light module 2 on one hand and the light source 5' of the side light module 3 on the other hand, relative to the respective optical axes A of the lenses arranged in front of them.

For the side light distribution $L_S$ to be embodied in a tapering manner while forming an inclined upper cut-off line 10 and an inclined lower cut-off line 11 in the direction of a free lateral end 17, the light source 5' of the side light module 3 is arranged rotated around the optical axis A by an angle φ relative to the light source 5 of the main light module 2. In the present embodiment of the invention, the light source 5 of the main light module 2 extends in the horizontal direction, so that all LED-light sources 8 of the light source 5 are arranged on a horizontal plane 12 cutting the optical axis A of the main light module 2. In contrast to this, the row of LED light sources 8 of the side light module 3 is arranged tilted by the angle φ relative to the horizontal plane 12, the LED light sources 8 left of the optical axis A in the driving direction being arranged below the horizontal plane 12 and the LED light sources 8 right of the optical axis A in the driving direction being arranged above the horizontal plane 12.

The lens of the main light module 2 is embodied plano-convex. The asymmetric lens 6 of the side light module 3 is embodied partly plano-convex. As can be seen in FIG. 1, it has the cut-off lateral area 7 which has a cut edge 13. The cut edge 13 forms an end of the aspherically embodied front lens face 14 of the asymmetric lens 6. On an opposite side, the front lens face 14 is limited by an outer edge 15. The cut edge 13 has a depth $t_S$ relative to a base plane 16 of the asymmetric lens 6 being larger than half of the overall depth t of the asymmetric lens 6. The cut edge 13 has a distance c1 relative to the central axis M' of the asymmetric lens 6 which is smaller than a distance $c_2$ of the opposite outer edge 15 relative to the central axis M'. A cut face 19 extends from the cut edge 13 to the base plane 16 of the asymmetric lens 6. The asymmetric lens 6 has, therefore, a smaller horizontal extension when compared to the lens of the main light module 2. The vertical extension of the asymmetric lens 6 is identical with that of the lens of the main light module 2.

The lens of the main light module 2 has a symmetrical embodiment with regard to the center plane M, with edges 15 of identical depth being provided on opposite sides. The asymmetric lens 7 of the side light module 3 is different from the lens of the main light module 2 in that it is cut off in a lateral area.

The light source 5' of the side light module 3 can be activated or deactivated independent of the light source of the main light module 2. The light source 5' of the side light module 3 can preferably be activated or deactivated depending on a steering direction of the vehicle, so that the light module 3 serves the creation of a bend lighting function. If for example the steering wheel of the vehicle is turned toward the left, the side light module 3 of the left-hand headlamp is switched on to illuminate a left-hand lateral area abutting on the main light distribution ($L_F$) in the horizontal direction. If the steering wheel of the vehicle is turned toward the right, the side light module 3 of the right-hand headlamp is switched on to illuminate a right-hand lateral area abutting on the main light distribution ($L_F$) which extends the main light distribution in the horizontal direction.

According to one embodiment of the invention, the LED light sources 8 of the light source 5' can be switched on optionally in a dimmed state in order to reduce the light intensity toward the end 17 of the total light distribution L. The LED light sources 8 providing a share of the illumination of a zone close to the end 17 are preferably provided with less power thank the LED light sources 8 of the light source 5' being used for the illumination of a zone of the side light distribution $L_S$ facing toward the high beam light distribution $L_F$.

The side light module is arranged offset in parallel relative to the main light module 2. The asymmetric lens 6 of the side light module 3 can be arranged on a common plane with the lens of the main light module 2. Optionally, the asymmetric lens 6 of the side light module 3 can also be arranged offset in the main radiation direction H relative to the lens of the main light module 2.

The asymmetric lens 6 of the side light module 3 respectively the lens of the main light module 2 can be made from a glass material or a transparent plastic material.

The asymmetric lens 6 is arranged on a lens holder 18 in a welded manner. The lens holder 18 is attached to the heatsink 4 in a customary manner. The bezel 9' encircling the asymmetric lens 6 as well as the bezel 9 encircling the lens of the main light module 2 are preferably fastened on a common housing 1. The lens holders 18 of the side light module 3 and of the main light module 2 can be fastened to the common heatsink 4.

On the one hand, the light distribution L represented in FIG. 3 comprises the main light distribution $L_F$ and on the other hand it comprises the side light distribution $L_S$ abutting on a left-hand edge of the main light distribution $L_F$.

LIST OF REFERENCE SIGNS

1 Housing
2 Main light module
3 Side light module
4 Heatsink
5, 5' Light source
6 Asymmetric lens
7 Lateral area
8 Light sources
9, 9' Bezel
10 Upper cut-off line
11 Lower cut-off line
12 Horizontal plane
13 Cut edge
14 Lens face
15 Outer edge
16 Base plane
17 End
18 Lens holder
19 Cut face
25, 26 Edge
$L_F$ High beam light distribution
$L_S$ Side light distribution
L Light distribution
a, b, c Distance
H Main radiation direction
M, M' Center plane
φ Angle
A Axis
$t_S$ Depth

The invention claimed is:

1. A lighting device for vehicles comprising:
at least one light module comprising:
a fixed main light module including:
a light source arranged on a substrate, and
a lens arranged unobstructedly at a distance to the light source, said lens for the creation of a given light distribution; and
a fixed side light module adjacent to the fixed main light module including:
a light source arranged on a substrate,
an asymmetric lens arranged unobstructedly at a distance to the light source so that a light beam radiated by the light source of the side light module creates a side light distribution extending a main light distribution created by the main light module in the lateral direction, and
wherein the light source of the side light module is arranged offset in the horizontal direction relative to an optical axis of the main light module, so that the side light distribution of the side light module abuts on the main light distribution of the main light module in the horizontal direction.

2. The lighting device according to claim 1 wherein the asymmetric lens of the side light module has a cut edge at a distance relative to a vertical center plane of the asymmetric lens being smaller than a distance of an opposite outer edge of the asymmetric lens relative to the vertical center plane.

3. The lighting device according to claim 2 wherein a cut face abutting on the cut edge of the asymmetric lens of the side light module has a depth relative to a base plane of the asymmetric lens which is larger than a half of the overall depth of the asymmetric lens.

4. The lighting device according to claim 1 wherein the side light module can be switched on or off depending on a steering direction of the vehicle.

5. The lighting device according to claim 1 wherein the side light module and the main light module each have a lens holder being fastened on a heatsink carrying the substrate for the respective light source.

6. The lighting device according to claim 1 wherein the light source of the side light module and of the main light module is embodied by a straight row of semiconductor-based light sources arranged next to one another, wherein the row of the semiconductor-based light sources of the side light module is arranged rotated by an angle relative to the row of semiconductor-based light sources of the main light module.

7. The lighting device according to claim 1 wherein the lens of the main light module is embodied plano-convex and that the asymmetric lens of the side light module is embodied partly plano-convex, wherein the asymmetric lens of the side light module has a cut-off lateral area.

8. The lighting device according to claim 1 wherein the side light module is arranged offset in parallel relative to the main light module in a common housing.

* * * * *